US005458684A

United States Patent [19]

Miller et al.

[11] Patent Number: 5,458,684

[45] Date of Patent: Oct. 17, 1995

[54] HOT MELT ADHESIVE SPRAY APPARATUS

[75] Inventors: Scott R. Miller, Roswell; Carl C. Cucuzza, Loganville, both of Ga.

[73] Assignee: Nordson Corporation, Westlake, Ohio

[21] Appl. No.: 194,077

[22] Filed: Feb. 9, 1994

[51] Int. Cl.[6] ..... B05C 11/00; B05C 5/00; B05B 1/30

[52] U.S. Cl. ..... 118/602; 239/127; 239/583; 222/318; 137/625.48; 118/313

[58] Field of Search ..... 118/602, 300, 118/313; 239/127, 583; 222/318, 424; 137/625.48

[56] References Cited

U.S. PATENT DOCUMENTS

| | | | |
|---|---|---|---|
| 1,925,109 | 9/1933 | Olson | 137/625.48 |
| 2,633,324 | 3/1953 | Bierman | 137/625.48 |
| 2,800,365 | 7/1957 | Hodges | 222/318 |
| 3,185,178 | 5/1965 | Bonnard | 137/625.48 |
| 3,993,099 | 11/1976 | Nightingale | 137/625.48 |
| 4,059,714 | 11/1977 | Scholl et al. | 156/78 |
| 4,200,207 | 4/1980 | Akers et al. | 222/190 |
| 4,687,137 | 8/1987 | Boger et al. | 239/124 |
| 4,743,188 | 3/1988 | Burdette et al. | 210/107 |
| 4,850,514 | 7/1989 | Scholl et al. | 222/146.5 |
| 4,874,451 | 10/1989 | Boger et al. | 156/291 |
| 4,983,109 | 1/1991 | Miller et al. | 425/7 |
| 4,995,333 | 2/1991 | Keller et al. | 118/300 |
| 5,238,190 | 8/1993 | Herke | 118/313 |

FOREIGN PATENT DOCUMENTS

3200470OS 12/1983 Germany .

*Primary Examiner*—W. Gary Jones
*Assistant Examiner*—Steven P. Griffin
*Attorney, Agent, or Firm*—Tarolli, Sundheim & Covell

[57] ABSTRACT

An improved apparatus for spraying hot melt adhesive includes a gear pump for providing a metered flow of hot melt adhesive. When a valve member is in a first position, a predetermined rate of flow of hot melt adhesive is conducted from the gear pump to a nozzle. When the valve member is in the first position, the valve member blocks a flow of adhesive to a recirculation passage. When the valve member is in a second position, the valve member directs the flow of adhesive from the gear pump to the recirculation passage and blocks a flow of adhesive to the nozzle.

2 Claims, 4 Drawing Sheets

HOT MELT ADHESIVE SPRAY APPARATUS

BACKGROUND OF THE INVENTION

The present invention relates to a hot melt adhesive spray apparatus for spraying hot melt adhesive at a predetermined flow rate onto an article.

A known apparatus for use in spraying hot melt adhesive onto an article, such as a backing sheet for a disposable diaper, is disclosed in U.S. Pat. No. 4,983,109 issued Jan. 8, 1991 to Miller et al. and entitled Spray Head Attachment For Metering Gear Head. The apparatus disclosed in this patent includes a hot melt adhesive spray nozzle which receives adhesive at a predetermined flow rate from a gear pump.

When it is desired to render the nozzle in this known apparatus ineffective to discharge hot melt adhesive, the nozzle is disconnected from a distribution manifold. A blocking plate is connected with the distribution manifold. The blocking plate has an internal passage which directs hot melt adhesive from a nozzle supply passage to a recirculation passage in the manifold. Due to the restricted space in which the apparatus for spraying hot melt adhesive is used, it is relatively difficult and time consuming to disconnect the nozzle from the manifold and to connect a blocking plate to the manifold when it is desired to render the nozzle ineffective to spray hot melt adhesive.

SUMMARY OF THE INVENTION

An improved apparatus for use in spraying hot melt adhesive onto an article includes a metering assembly for providing a predetermined flow of hot melt adhesive to a valve chamber. When a valve member is in the first position in the valve chamber, the valve member directs the flow of hot melt adhesive to a nozzle supply passage. The valve member is movable to a second position in which the valve member blocks the flow of hot melt adhesive to the nozzle and directs the flow of hot melt adhesive to a recirculation passage.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENT

Figure 1:
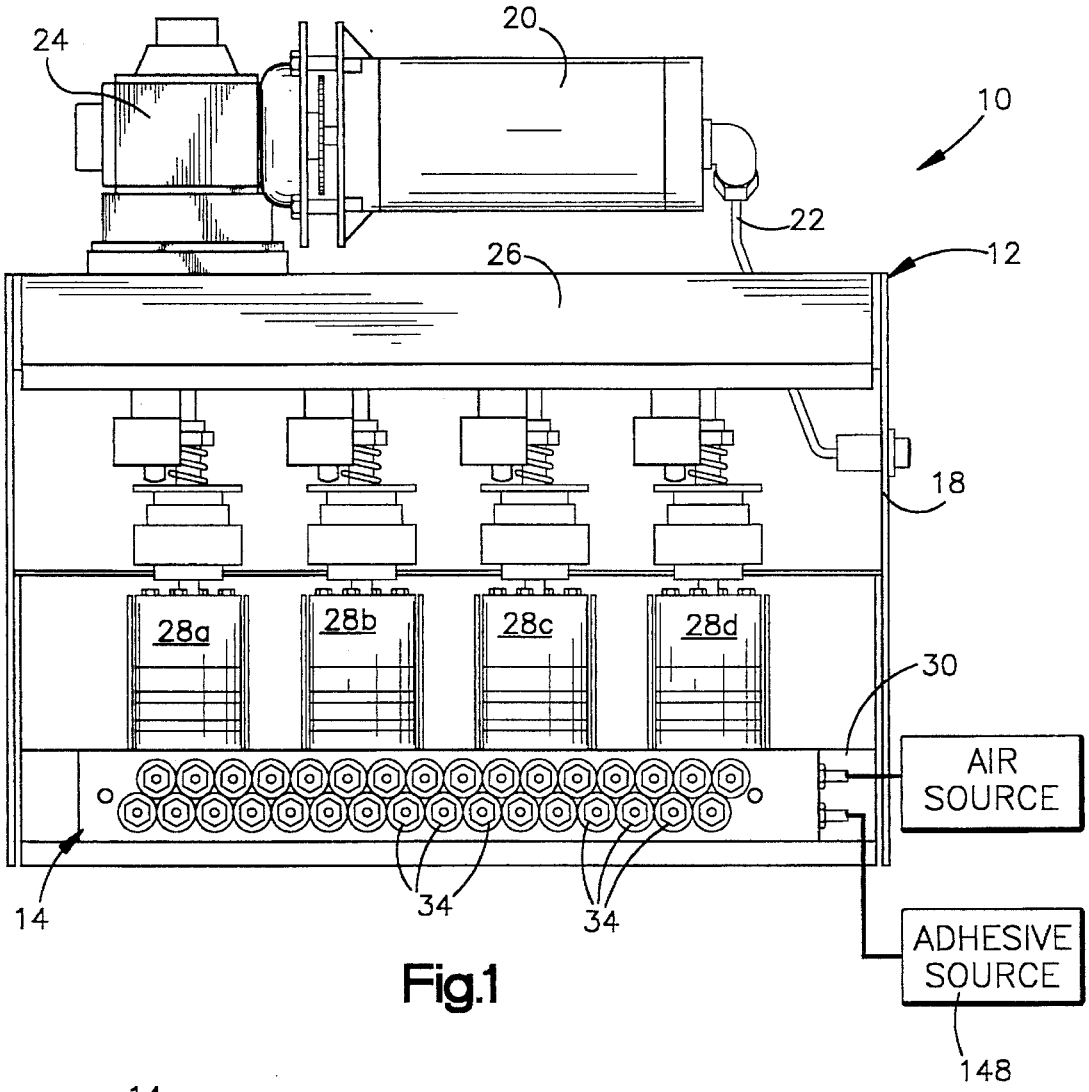
FIG. 1 is a simplified schematic bottom view of a metering gear head and spray head attachment for use in spraying hot melt adhesive.

A known apparatus 10 (FIG. 1) is used to spray hot melt adhesive onto articles, such as the backing sheet used in the formation of hygienic articles including disposable diapers. The apparatus 10 includes a metering gear head 12 and a spray head attachment 14. The metering gear head 12 includes a housing 18 upon which an electric motor 20 is mounted. The electric motor 20 is connected with a source of electrical energy through a conductor or cable 22.

The output of the electric motor 20 is transmitted to a gear reducer 24 which is connected to a transmission 26. The transmission 26 extends across the top of the housing 18. The transmission 26 is drivingly connected with four fixed displacement metering or gear pumps 28*a–d* which are located in the interior of the housing 18.

The metering or gear pumps 28*a–d* are connected in fluid communication with a manifold 30 disposed at the base of the housing 18. The output from the metering or gear pumps 28*a–d* is conducted to the inlet of individual adhesive spray nozzles 34 which are connected with the manifold 30. The fixed displacement gear pumps 28*a–d* are operable to supply precise quantities of hot melt adhesive to each of the nozzles 34. Therefore, each of the nozzles 34 is effective to spray a precise quantity of hot melt adhesive onto an article. The construction of the apparatus 10 is the same as is disclosed in the aforementioned U.S. Pat. No. 4,983,109 issued Jan. 8, 1991 to Miller et al. and entitled Spray Head Attachment For Metering Gear Head.

It should be understood that the apparatus 10 may have a construction which is different than the construction illustrated in FIG. 1. This is because the apparatus 10 will be used in association with many different types of conveyors to spray hot melt adhesive on articles having many different configurations. The arrangement of the apparatus 10 will depend upon the available space at a hot melt adhesive application station in the article processing system with which the apparatus is used. In addition, the arrangement of the apparatus 10 will, in part, be dictated by the configuration of the particular article to which the hot melt adhesive is to be applied.

Figure 2:
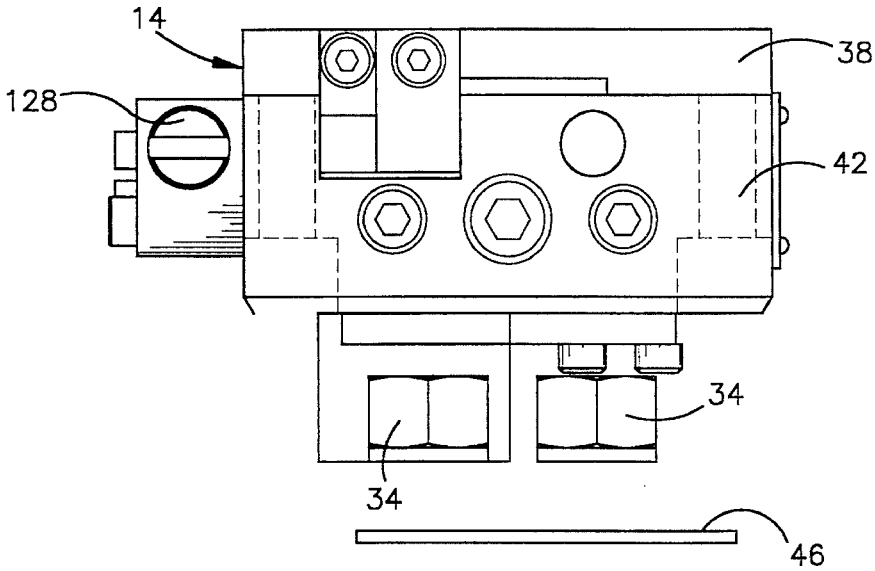
FIG. 2 is a side elevational view of a hot melt adhesive spraying apparatus which may be used in the metering gear head and spray head attachment of FIG. 1.

A spray head attachment 14, constructed in accordance with the present invention, is illustrated in FIG. 2. The spray head attachment 14 is utilized to spray hot melt adhesive onto an article at a predetermined flow rate. The spray head attachment 14 is connected with the manifold 30 (FIG. 1) which is supplied with precisely measured flows of hot melt adhesive by the metering or gear pumps 28*a–d*. The spray head attachment 14 includes a distribution plate 38 (FIG. 2) which is connected to the manifold 30.

The spray head attachment 14 also includes a nozzle plate 42 which is fixedly connected to the distribution plate 38 and the manifold 30. The nozzles 34 are mounted on the nozzle plate 42. In the FIG. 2, the nozzles 34 are shown facing downward so they can spray hot melt adhesive onto an article, such as a backing sheet 46 of a moisture impervious, heat sensitive material such as polypropylene, polyethylene or polyurethane. However, it should be understood that the nozzles 34 may be used in many different orientations to spray hot melt adhesive onto many different articles having many different configurations.

Figure 3:
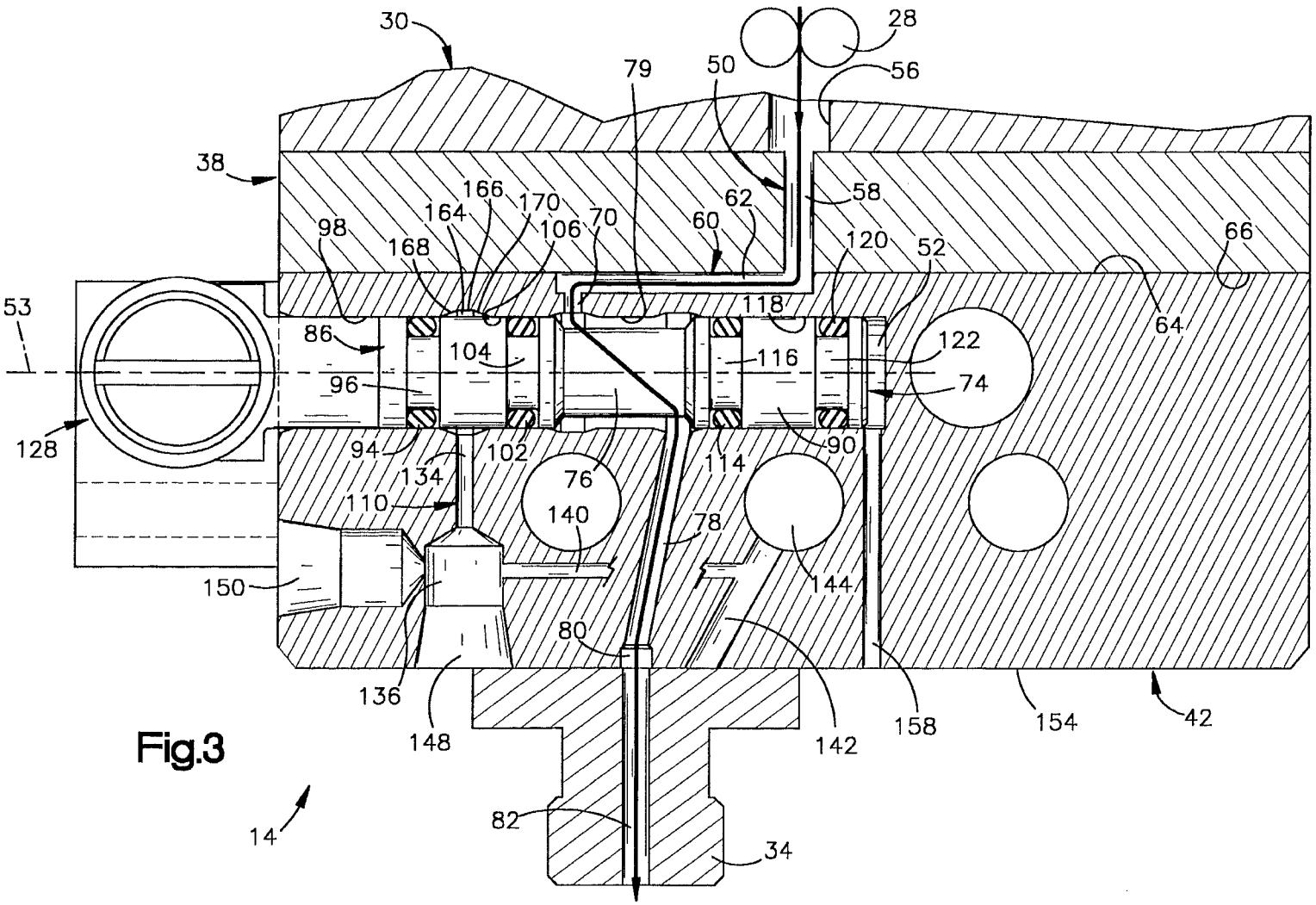
FIG. 3 is an enlarged fragmentary cross sectional view illustrating the relationship between a valve member and a nozzle in the apparatus of FIG. 2, the valve member being shown in a first position in which it is effective direct a flow of hot melt adhesive to a nozzle.

The manifold 30 is supplied with a precisely measured flow of hot melt adhesive from a metering or gear pump 28, in the manner indicated schematically in FIG. 3. The hot melt adhesive is conducted from the metering or gear pump 28 through a main supply passage 50 to a valve chamber 52 in the nozzle plate 42. The hot melt adhesive is conducted, at a flow rate determined by the speed of operation of the fixed displacement gear pump 28, from the valve chamber 52 to either a nozzle supply passage 78 or a recirculation passage 110. The valve chamber 52 has a central axis 53.

The main supply passage 50 includes a manifold passage 56 formed in the manifold 30 and connected in fluid communication with fixed displacement gear pump 28 (FIG. 3). The manifold passage 56 is connected in communication with a distribution plate passage 58 formed in the distribution plate 38. Although the distribution plate passage 58 has been shown in FIG. 3 as having a simple linear configuration, it should be understood that the passage could have a substantially more complex configuration, depending upon the requirements of the particular article processing system with which the spray head attachment 14 is associated.

The hot melt adhesive is conducted from the distribution plate passage 58 to a nozzle plate passage 60. The nozzle plate passage 60 is formed by a groove 62 in an upper (as viewed in FIG. 3) side surface 64 of the nozzle plate 42. A lower side surface 66 of the distribution plate 38 cooperates with the groove 62 in the nozzle plate 42 to form a portion of the nozzle plate passage 60. The nozzle plate passage 60 has an outlet 70 to the valve chamber 52.

In accordance with a feature of the present invention, a valve member 74 is operable to direct the flow of hot melt adhesive to either the nozzle supply passage 78 or the recirculation passage 110. When the spool type valve member 74 is in a first or open position shown in FIG. 3, hot melt adhesive is conducted around a cylindrical central portion 76 of the valve member to the nozzle supply passage 78 formed in the nozzle plate 42. A cylindrical surface 79 is formed in the nozzle plate 42 and extends between the outlet 70 from the nozzle plate passage 60 to an inlet to the nozzle supply passage 78. The nozzle supply passage 78 has an outlet 80 connected with a passage 82 in the nozzle 34. The hot melt adhesive is sprayed from the nozzle 34 onto an article, such as the backing sheet 46 (FIG. 2), at a rate determined by the speed of operation of the fixed displacement gear pump 28.

The valve member 74 includes a cylindrical first or left (as viewed in FIG. 3) end portion 86 which is connected to one end of the cylindrical central portion 76. The first end portion 86 is disposed in a coaxial relationship with the central portion 76. The valve member 74 also has a cylindrical second or right (as viewed in FIG. 3) end portion 90 which is connected with the opposite end of the central portion 76. The end portion 90 of the valve member 74 is disposed in a coaxial relationship with the central portion 76 and the first end portion 86.

A first annular seal element 94 is disposed in an annular recess 96 formed in the left end portion 86 of the valve member 74. The first annular seal element 94 is disposed in sealing engagement with the recess 96 in the first end portion 86 of the valve member 74. In addition, the first annular seal element 94 is disposed in sealing engagement with a first or left cylindrical surface 98 of the valve chamber 52.

A second annular seal element 102 is disposed in a second annular recess 104 formed in the first end portion 86 of the valve member 74. The second annular seal element 102 is disposed in sealing engagement with the recess 104 in the first end portion 86 of the valve member 74. In addition, the second seal element 102 sealingly engages a cylindrical surface 106 of the valve chamber 52.

The first and second annular seal elements 94 and 102 block a flow of hot melt adhesive to the recirculation passage 110 when the valve member 74 is in the first or open position of FIG. 3. Therefore, all of the precisely metered flow of hot melt adhesive from the main supply passage 50 is conducted through the valve chamber 52 and nozzle supply passage 78 to the nozzle 34. This results in hot melt adhesive being sprayed by the nozzle 34, at a flow rate determined by the speed of operation of the fixed displacement metering pump 28.

A third annular seal element 114 is disposed in an annular recess 116 formed in the second or right end portion 90 of the valve member 74. The third annular seal element 114 is disposed in sealing engagement with the recess 116 and with a cylindrical side surface 118 of the valve chamber 52 when the valve member 74 is in the first or open position of FIG. 3. A fourth annular seal element 120 is disposed in an annular recess 122 formed in the second or right end portion of the valve member 74. The fourth annular seal element is disposed in sealing engagement with the recess 122 and with the cylindrical surface 118 of the valve chamber 52.

In the illustrated embodiment of the invention, the seal elements 94, 102, 114 and 120 are 0-ring seals. However, other known types of seal elements may be used if desired.

Figure 4:
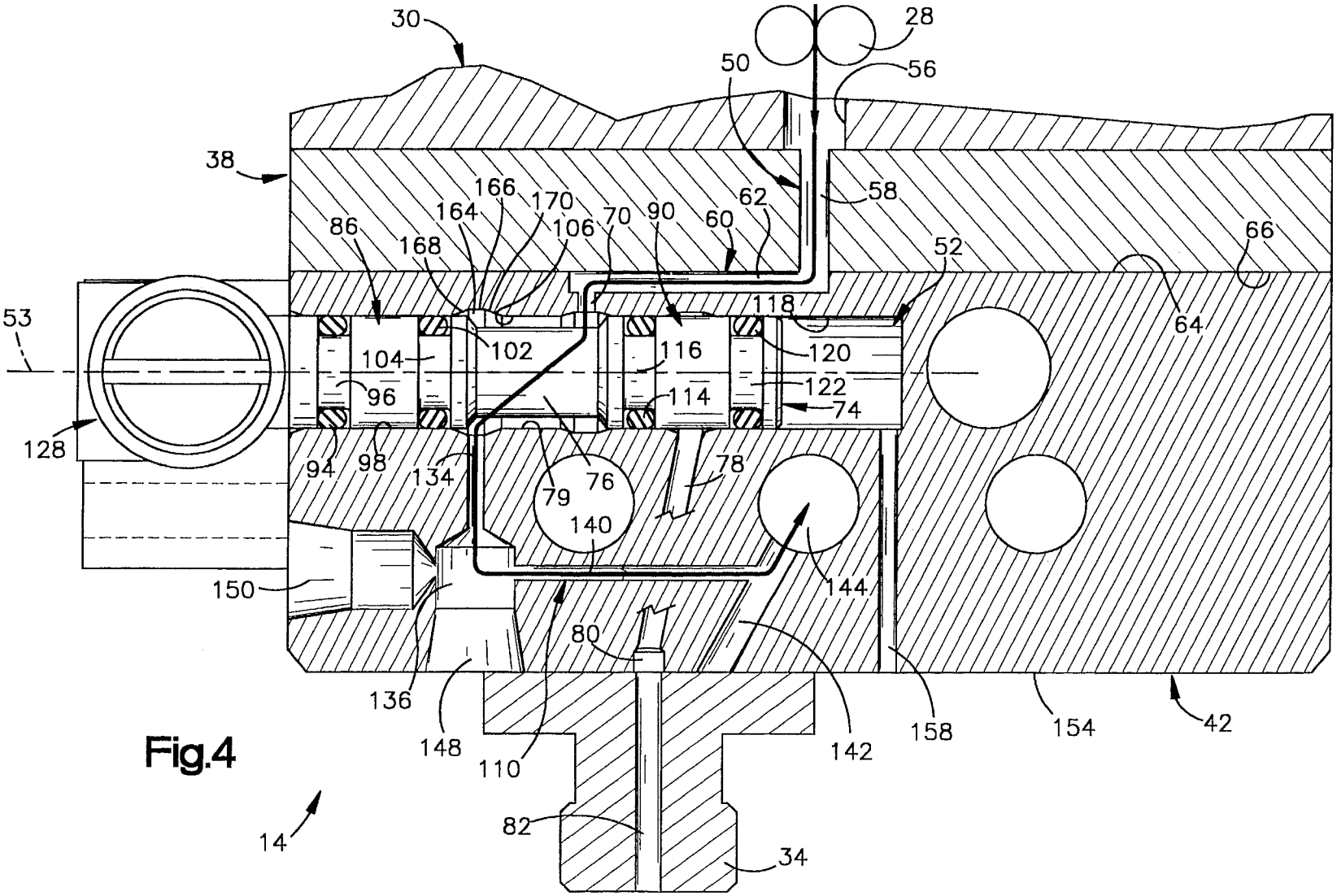
FIG. 4 is a cross sectional view, generally similar to FIG. 3, illustrating the valve member in a second position in which the valve member is effective to direct a flow of hot melt adhesive to a recirculation passage and to block a flow of hot melt adhesive to the nozzle.

A valve actuator 128 is manually operable to move the valve member 74 from the first or open position of FIG. 3 to a second or closed position illustrated in FIG. 4. When the valve member 74 is in the second or closed position of FIG. 4, the hot melt adhesive from the metering pump 28 is directed from the main supply passage 50 to the recirculation passage 110. At this time, the valve member 74 blocks the flow of the hot melt adhesive from the valve chamber 52 to the nozzle supply passage 78 and the nozzle 34.

The recirculation passage 110 includes a first or initial section 134 which extends downward to a cavity 136. A second section 140 of the recirculation passage 110 extends from the cavity 136 to a third section 142 of the recirculation passage. The third section 142 of the recirculation passage 110 opens into a main recirculation passage 144 formed in the nozzle plate 42. The main recirculation passage 144 is connected with an adhesive source 148 (FIG. 1). Adhesive from the source 148 is supplied to the metering or gear pumps 28*a–d*. If desired, the recirculated hot melt adhesive could be supplied directly to the metering or gear pumps 28*a–d* from the main recirculation passage 144.

The cavity 136 is formed in the nozzle plate 42 to facilitate drilling of the first and second sections 134 and 140 of the recirculation passage 110. Thus, the first section 134 of the recirculation passage is drilled and the cavity 136 is formed. A plug 148 is provided to block off the first section 134 of the recirculation passage 110. The second section 140 of the recirculation passage 110 is then drilled and a plug 150 blocks off the second section 140 of the recirculation passage 110. Of course, the order of forming the first and second sections 134 and 140 of the recirculation passage 110 could be reversed.

The third section 142 of the recirculation passage is formed by drilling from a lower (as viewed in FIG. 4) side surface 154 of the nozzle plate 42 to the main recirculation passage 144. The nozzle 34 blocks the opening to the third section 142 of the recirculation passage 110 at the lower side surface 154 of the nozzle plate 42. The second section 140 of the recirculation passage 134 intersects the third section 142 of the recirculation passage.

Upon operation of the valve actuator assembly 128 to move the valve member 74 from the second or closed position of FIG. 4 to the open position of FIG. 3, the valve member 74 is moved toward the right in the valve chamber 52. When this occurs, air is exhausted from the valve chamber 52 to the atmosphere through a vent passage 158 which extends from the lower side surface 154 of the nozzle plate 42 to the valve chamber 52. When the valve member 74 is moved from the first or open position of FIG. 3 back to the second or closed position of FIG. 4, air is drawn into the valve chamber 52 through the vent passage 158.

During movement of the valve member 74 from the first or open position of FIG. 3 to the second or closed position of FIG. 4, the seal element 102 moves across the inlet to the recirculation passage 110. To minimize wear of the seal element 102 as it moves across the inlet to the recirculation passage 110, an annular recess 164 (FIG. 4) is formed in the nozzle plate 42. The annular recess 164 has a cylindrical central surface 166 and a pair of sloping side surfaces 168 and 170. The side surfaces 168 and 170 are formed as portions of cones. The side surface 168 extends between the cylindrical central surface 166 and the cylindrical surface 98. Similarly, the sloping side surface 170 extends between the cylindrical central surface 166 and the cylindrical surface 106.

During movement of the valve member 74 from the first or open position of FIG. 3 to the second or closed position of FIG. 4, the seal element 102 moves from engagement with the cylindrical surface 106 into engagement with the sloping side surface 170. The radial expansion of the annular seal element is insufficient to cause sealing engagement of the seal element 102 with the cylindrical central surface 166 of the recess 164. However, as the leftwardly (as viewed in FIGS. 3 and 4) movement of the valve member 74 toward the closed position shown in FIG. 4 continues, the seal element 102 engages the sloping side surface 168 and is gently forced back into the recess 104 in the valve member 74. Similarly, upon movement of the valve member 74 from the closed position of FIG. 4 back to the open position of FIG. 3, the sloping side surface 170 gently forces the seal element 102 into the recess 104 as the valve member 74 approaches the open position of FIG. 3. By providing the sloping side surfaces 168 and 170, wear of the valve element 102 is minimized.

The entrance to the nozzle supply passage 78 is provided with a similar recess to the recess 166 and has sloping side surfaces, similar to the sloping side surfaces 168 and 170. This minimizes wear of the seal element 114 during movement of the valve member 74 between the open and closed positions. The outlet from the main supply passage 50 has the same configuration as the inlets to the nozzle supply passage 78 and recirculation passage 110.

Figure 5:
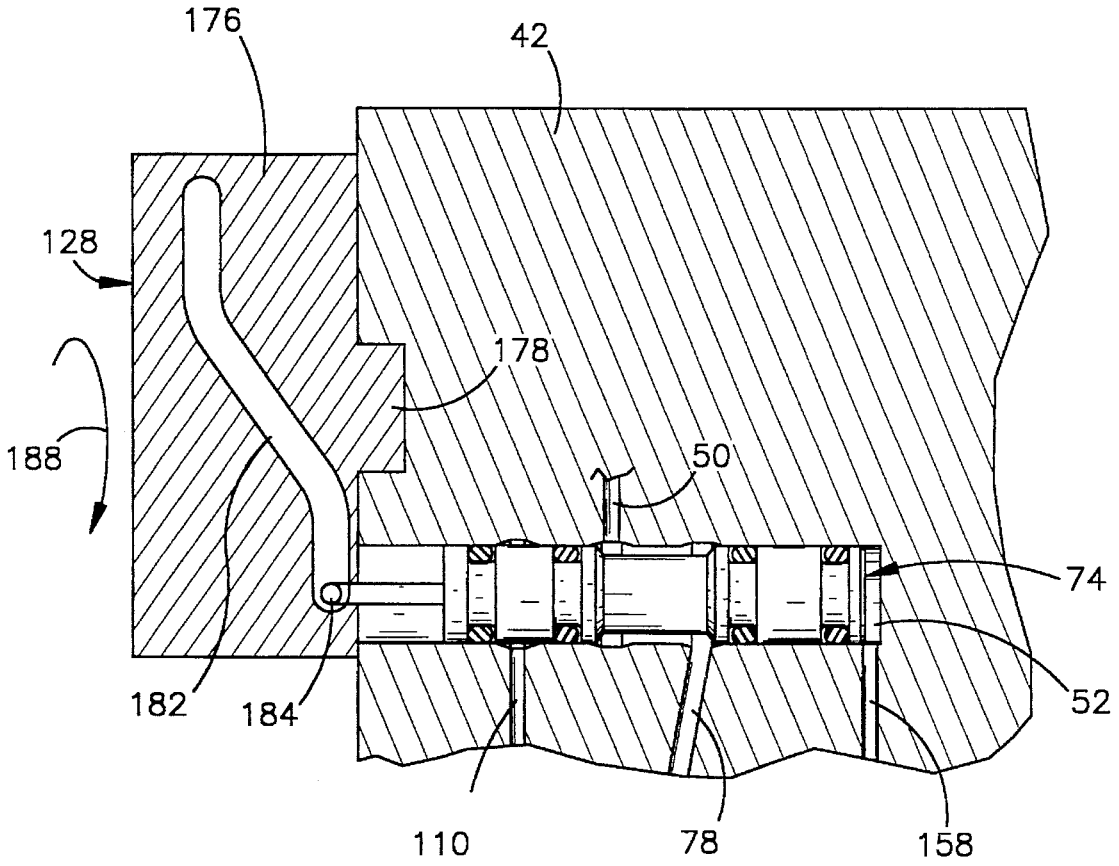
FIG. 5 is a highly schematicized illustration of an actuator assembly for moving the valve member between the position shown in FIG. 3 and the position shown in FIG. 4.

The valve actuator 128 is illustrated schematically in FIG. 5. The valve actuator 128 includes a manually rotatable actuator member 176. The actuator member 176 is rotatably supported on the nozzle plate 42 in the manner indicated schematically at 178 in FIG. 5. The actuator member 176 has a cam track 182 which engages a cam follower 184 connected with the valve member 74.

Upon rotation of the actuator member 176 the direction indicated by the arrow 188 in FIG. 5, the cam track 182 moves the cam follower 184 toward the left to move the valve member 74 from the first or open position of FIG. 3 to the second or closed position of FIG. 4. Similarly, upon rotation of the actuator member 176 in the opposite direction, the cam track 182 cooperates with the cam follower 184 to move the valve member from the closed position back to the open position. Although one specific valve actuator assembly 128 has been shown schematically in FIG. 5, it should be understood that many different types of valve actuator assemblies could be utilized if desired. For example, the cam surface could be connected with the valve member 74 and the cam follower connected with the valve actuator. If desired, a solenoid type valve actuator could be utilized to move the valve member 74 between the open position of FIG. 3 and the closed position of FIG. 4. Of course, other known types of valve actuators could be utilized.

In view of the foregoing description, it is apparent that the present invention provides a new and improved apparatus 10 for use in spraying hot melt adhesive onto an article 46. The apparatus 10 includes a metering assembly 28 for providing a predetermined flow of hot melt adhesive to a valve chamber 52. When a valve member 74 is in the first position in the valve chamber 52, the valve member directs the flow of hot melt adhesive to a nozzle supply passage 78. The valve member 74 is movable to a second position in which the valve member blocks the flow of hot melt adhesive to the nozzle 34 and directs the flow of hot melt adhesive to a recirculation passage 110.

Having described the invention, the following is claimed:

1. An apparatus for use in spraying hot melt adhesive onto an article, said apparatus comprising flow metering means for discharging a metered flow of hot melt adhesive, a distribution member connected in fluid communication with said flow metering means, said distribution member having a side surface, a nozzle plate having a first side surface disposed in engagement with said side surface of said distribution member and a second side surface, a plurality of nozzles connected with said second side surface of said nozzle plate for directing a flow of hot melt adhesive toward the article, surface means for defining a valve chamber within said nozzle plate at a location spaced from said first and second side surfaces of said nozzle plate, main supply passage means disposed in said nozzle plate for conducting hot melt adhesive from said distribution member and said first side surface of said nozzle plate to said valve chamber, nozzle supply passage means disposed within said nozzle plate for conducting hot melt adhesive from said valve chamber to one of said nozzles, recirculation passage means disposed within said nozzle plate for conducting hot melt adhesive from said valve chamber, a valve member disposed within said valve chamber in said nozzle plate, said valve member being movable in said valve chamber between a first position and a second position, said valve member directing a flow of hot melt adhesive from said valve chamber to said nozzle supply passage means when said valve member is in the first position, said valve member blocking flow of hot melt adhesive from said valve chamber to said recirculation passage means when said valve member is in the first position, said valve member directing a flow of hot melt adhesive from said valve chamber to said recirculation passage means when said valve member is in the second position, said valve member blocking flow of hot melt adhesive from said valve chamber to said nozzle supply passage means when said valve member is in the second position, and actuator means for moving said valve member between the first and second positions, said actuator means being connected with said valve member and said nozzle plate for moving said valve member between the first and second positions in said nozzle plate.

2. An apparatus for use in spraying hot melt adhesive set forth in claim 1 wherein said valve member Includes a central portion, a first end portion connected with a first end of said central portion and a second end portion connected with a second end of said central portion, first and second annular seal elements disposed in a spaced apart relationship on said first end portion of said valve member, third and fourth annular seal elements disposed in a spaced apart relationship on said second end portion of said valve member, said surface means including a first cylindrical surface area disposed in said valve chamber adjacent to a first side of an inlet to said recirculation passage means, a second cylindrical surface area disposed in said valve chamber between the inlet to said recirculation passage means and an outlet from said main supply passage means, a third cylindrical surface area disposed in said valve chamber between the outlet from said main supply passage means and an inlet to said nozzle supply passage means, and a fourth cylindrical surface area disposed in said valve chamber adjacent to a side of the inlet to said nozzle supply passage means opposite from said third cylindrical surface area, said first annular seal element being disposed in engagement with said first cylindrical surface area and said second annular seal element being disposed in engagement with said second cylindrical surface area to block flow of hot melt adhesive to the inlet to said recirculation passage means when said valve member is in the first position, said third and fourth annular seal elements being disposed in engagement with said fourth cylindrical surface area and being spaced from said third cylindrical surface area to enable hot melt adhesive to flow from the outlet from said main supply passage means around the central portion of said valve member to the inlet to said nozzle supply passage means when said valve member is in the first position, said first and second annular seal elements being disposed in engagement with said first cylindrical surface area and being spaced from said second cylindrical surface area to enable hot melt adhesive to flow from the outlet from said main supply passage means around the central portion of said valve member to the inlet to said recirculation passage means when said valve member is in the second position, said third annular seal element being disposed in engagement with said third cylindrical surface area and said fourth annular seal element being disposed in engagement with said fourth cylindrical surface area to block flow of hot melt adhesive to the inlet to said nozzle supply passage means when said valve member is in the second position.

* * * * *